US010777043B2

(12) United States Patent
Kroon

(10) Patent No.: US 10,777,043 B2
(45) Date of Patent: Sep. 15, 2020

(54) SYSTEMS AND METHODS FOR PROVIDING A FEATURE GAME

(71) Applicant: Aristocrat Technologies Australia Pty Limited, North Ryde, NSW (AU)

(72) Inventor: James Kroon, Macquarie Park (AU)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 0 days.

(21) Appl. No.: 16/547,154

(22) Filed: Aug. 21, 2019

(65) Prior Publication Data

US 2019/0378377 A1 Dec. 12, 2019

Related U.S. Application Data

(63) Continuation of application No. 15/988,598, filed on May 24, 2018, now Pat. No. 10,424,158, which is a (Continued)

(30) Foreign Application Priority Data

Aug. 12, 2014 (AU) ..... 2014903136

(51) Int. Cl.
*G07F 17/32* (2006.01)
*G07F 17/34* (2006.01)

(52) U.S. Cl.
CPC ..... *G07F 17/3258* (2013.01); *G07F 17/3262* (2013.01); *G07F 17/34* (2013.01)

(58) Field of Classification Search
CPC ..... G07F 17/34
See application file for complete search history.

(56) References Cited

U.S. PATENT DOCUMENTS 6,319,124 B1 * 11/2001 Baerlocher ..... G07F 17/3211 273/138.1
8,066,563 B1 * 11/2011 Schultz ..... G07F 17/3244 463/16

(Continued)

OTHER PUBLICATIONS

Australian Search Report for AU2017202972, dated Dec. 5, 2017, 3 pages.

(Continued)

*Primary Examiner* — Reginald A Renwick
(74) *Attorney, Agent, or Firm* — McAndrews, Held & Malloy, Ltd.

(57) ABSTRACT

An electronic gaming machine includes a display in the form of a matrix of rows and columns and a controller configured to conduct a game instance upon receiving a wager via a player input. In conducting each game instance, the controller activates a number of columns on the display based on the wager and controls a display to indicate which columns in the display have been activated. The controller determines if any of the activated columns meets a triggering condition and controls the display to display the activated columns which meet the triggering condition with a modified background. The controller then determines an outcome of the game instance based on whether a predetermined number of activated columns which meet the triggering condition are adjacent one another and makes an award to the player based on the outcome of the instance.

20 Claims, 9 Drawing Sheets

Related U.S. Application Data continuation of application No. 14/824,575, filed on Aug. 12, 2015, now Pat. No. 9,997,021.

(56) References Cited

U.S. PATENT DOCUMENTS

| | | | | |
|---|---|---|---|---|
| 8,075,389 | B1 * | 12/2011 | Schultz | G07F 17/3244 463/16 |
| 8,506,380 | B2 * | 8/2013 | Hughes | G07F 17/3265 463/20 |
| 9,569,914 | B2 | 2/2017 | Kono et al. | |
| 9,646,458 | B2 | 5/2017 | Zielinksi | |
| 9,836,922 | B2 * | 12/2017 | Jackson | G07F 17/326 |
| 2003/0064773 | A1 * | 4/2003 | Baerlocher | G07F 17/3244 463/16 |
| 2003/0073484 | A1 | 4/2003 | Jo | |
| 2004/0053677 | A1 | 3/2004 | Hughs-Baird | |
| 2004/0178579 | A1 * | 9/2004 | Lowell | A63F 3/062 273/269 |
| 2005/0056999 | A1 * | 3/2005 | Roemer | G07F 17/32 273/273 |
| 2005/0075162 | A1 * | 4/2005 | Duhamel | G07F 17/32 463/20 |
| 2006/0121978 | A1 * | 6/2006 | Hornik | G07F 17/3244 463/20 |
| 2006/0246977 | A1 * | 11/2006 | Cannon | G07F 17/3244 463/13 |
| 2006/0258419 | A1 | 11/2006 | Winkler | |
| 2008/0032767 | A1 * | 2/2008 | Okada | G07F 17/3244 463/20 |
| 2009/0054129 | A1 * | 2/2009 | Yoshimura | G07F 17/32 463/20 |
| 2009/0111566 | A1 * | 4/2009 | Naicker | G07F 17/34 463/20 |
| 2009/0111569 | A1 | 4/2009 | Yoshizawa | |
| 2010/0048284 | A1 * | 2/2010 | Jaffe | G07F 17/3258 463/20 |
| 2012/0034967 | A1 * | 2/2012 | Owen | G07F 17/34 463/20 |
| 2013/0109458 | A1 | 5/2013 | Demsetz | |
| 2013/0217464 | A1 * | 8/2013 | Terdina | G07F 17/3211 463/20 |
| 2014/0066198 | A1 * | 3/2014 | Robbins | G06K 9/20 463/31 |

OTHER PUBLICATIONS

Australian Examination Report for AU2018274893, dated Jan. 17, 2020, 2 pages.

Office Action dated Jun. 26, 2020 for U.S. Appl. No. 16/743,595 (pp. 1-6).

* cited by examiner

SYSTEMS AND METHODS FOR PROVIDING A FEATURE GAME

RELATED APPLICATIONS

This application is a continuation of U.S. patent application Ser. No. 15/988,598, filed May 24, 2018, which is a continuation of U.S. patent application Ser. No. 14/824,575 filed Aug. 12, 2015, which claims priority to Australian Provisional Patent Application No. 2014903136, filed Aug. 12, 2014, the disclosures of which are incorporated herein by reference in their entirety.

BACKGROUND OF THE INVENTION

In existing gaming systems, feature games may be triggered for players in addition to the base game. A feature game gives players an additional opportunity to win prizes, or the opportunity to win larger prizes, than would otherwise be available in the base game. Feature games can also offer altered game play to enhance player enjoyment.

In some gaming systems, the feature game may give players access to a linked prize, such as a progressive jackpot. Such linked prizes are funded through contributions from a plurality of linked gaming machines that make up the gaming system, and are therefore often much larger than prizes otherwise available in standalone gaming machines.

While such gaming systems provide players with enjoyment, a need exists for alternative methods to provide feature games in gaming systems.

BRIEF SUMMARY OF THE INVENTION

According to one aspect of the invention there is provided a gaming machine configured to provide a play of a game, the gaming machine comprising:

a symbol selector for selecting:

a) a plurality of backgrounds from a set of backgrounds for display at respective ones of a plurality of display positions, the set of backgrounds including winning backgrounds and non-winning backgrounds, and b) a plurality of symbols from a set of symbols for display at respective ones of said plurality of display positions, the selected symbols being displayed at each display position overlaid upon a selected background; and an outcome evaluator for determining when a trigger event occurs, said trigger event being defined when at least two winning backgrounds of said plurality of backgrounds are selected for display adjacent to each other;

wherein said plurality of symbols and said plurality of backgrounds are selected independently of each other and wherein the set of backgrounds is such that at least one outcome of the game includes a display position at which a symbol is overlaid upon a non-winning background. In an embodiment, each display position is associated with one of a plurality of columns, said backgrounds being only selectable in a display position when the associated columns are activated.

In an embodiment, the trigger event comprises a winning background being selected for display at each display position of a predefined number of associated columns that are located adjacent each other on the display.

In an embodiment, a second chance event occurs in response to a plurality of winning backgrounds being selected for display at each display position of at least one associated column, said second chance event being an opportunity to activate said trigger event. The second chance event comprises selecting at least one activated column and modifying the selected column such that each associated display position of that selected column displays a background.

In some embodiments, before said plurality of symbols are selected, at least one activated column is selected for modification, said modification comprising modifying each symbol to be displayed at a display position of that selected column into a function symbol. Additionally or alternatively, also before said plurality of symbols are selected, at least one activated column is selected for modification, said modification comprising displaying a winning background at each display position of that selected column.

In the above embodiments, where an activated column is selected for said modification, that activated column is selected at random.

In some embodiments, the plurality of columns are activated according to a predefined sequence. Furthermore, in some embodiments, a respective indicator is displayed for each column that is activated According to another aspect of the invention there is provided a method of playing a game on a gaming machine, the method comprising the steps of:

selecting, using a symbol selector, a plurality of backgrounds from a set of backgrounds for display at respective ones of a plurality of display positions, the set of backgrounds including winning backgrounds and non-winning backgrounds;

selecting, using said symbol selector a plurality of symbols from a set of symbols for display at respective ones of said plurality of display positions, the selected symbols being displayed at each display position overlaid upon a selected background; and determining, using a an outcome evaluator, when a trigger event occurs, said trigger event being defined when at least two winning backgrounds of said plurality of backgrounds are selected for display adjacent to each other;

wherein said plurality of symbols and said plurality of backgrounds are selected independently of each other and wherein the set of backgrounds is such that at least one outcome of the game includes a display position at which a symbol is overlaid upon a non-winning background.

According to another aspect of the invention there is provided computer program code which when executed by components of a controller of a gaming system implements the method described above.

According to another aspect of the invention there is provided a tangible computer readable medium comprising the computer program code described above.

According to another aspect of the invention, there is provided a gaming machine configured to provide a play of a game, the gaming machine comprising:

a symbol selector for selecting:

a) for each of a plurality of columns of symbol display positions, a plurality of symbols from respective ones of a plurality of reel strips associated with respective ones of the columns by selecting a stopping position for each of the reel strips;

b) for each active column of the plurality of columns a stopping position of a background reel strip, each background reel strip comprising a plurality of backgrounds and a plurality of blank positions; and an outcome evaluator for determining when a trigger event occurs, said trigger event being defined when at least two backgrounds are selected for display adjacent to each other, wherein for each active column, said plurality of symbols and said stopping positions for the respective background reel strip are selected independently of each other and wherein the selected symbols are displayed overlaid upon any selected background.

According to another aspect, there is provided a method of playing a game on a gaming machine, the method comprising the steps of: selecting, using a symbol selector, for each of a plurality of columns of symbol display positions, a plurality of symbols from respective ones of a plurality of reel strips associated with respective ones of the columns by selecting a stopping position for each of the reel strips;

selecting, using said symbol selector, for each active column of the plurality of columns a stopping position of a background reel strip, each background reel strip comprising a plurality of backgrounds and a plurality of blank positions; and determining, using an outcome evaluator, when a trigger event occurs, said trigger event being defined when at least two backgrounds are selected for display adjacent to each other, wherein for each active column, said plurality of symbols and said stopping positions for the respective background reel strip are selected independently of each other and wherein the selected symbols are displayed overlaid upon any selected background.

BRIEF DESCRIPTION OF SEVERAL VIEWS OF THE DRAWINGS

Features and advantages of certain embodiments of the present invention will become apparent from the following description of embodiments thereof, by way of example only, with reference to the accompanying drawings, in which.

Figure 1:
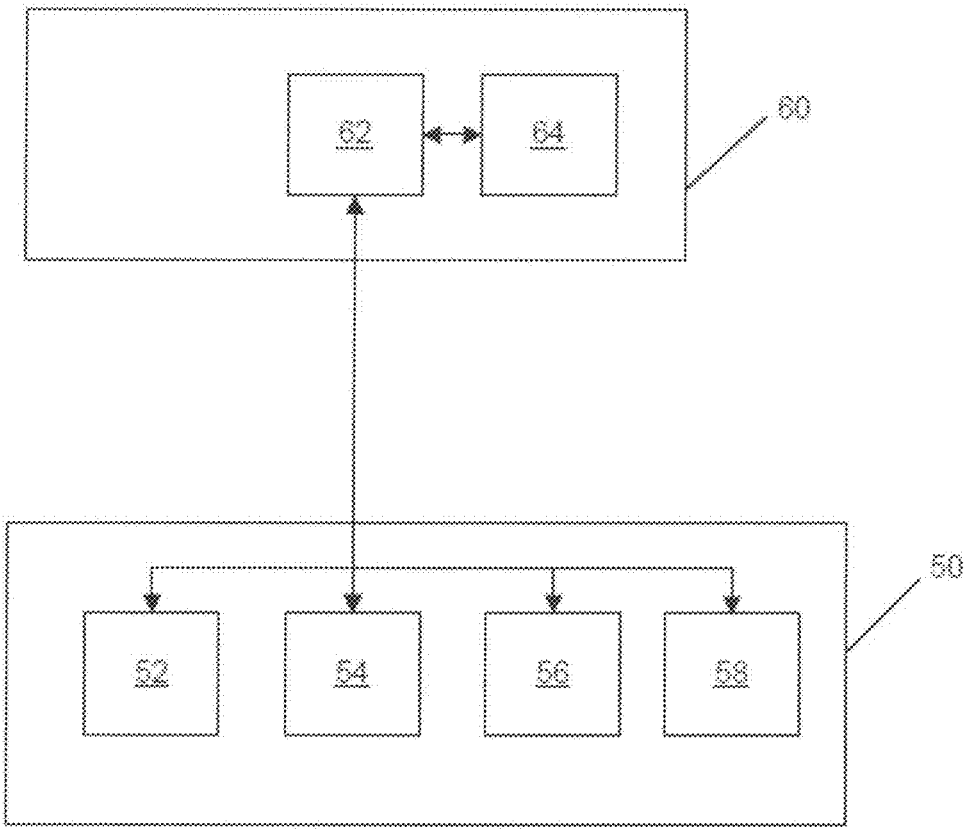
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to the drawings, there are shown example embodiments of gaming systems which are arranged to trigger a linked jackpot prize. In these embodiments, symbols are selected from a set of symbols to be displayed in respective ones of a plurality of display positions, as is known in the art. In addition, a linked jackpot prize may be triggered when a plurality of backgrounds are also selected for display at the display positions. The invention is not limited to triggering a linked jackpot prize, however. In other embodiments, any number of prizes, jackpots or otherwise, may be triggered by the system and methods described herein.

Furthermore, embodiments of the present invention may also be used to trigger other events, such as feature games or opportunities to win the linked jackpot prize.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
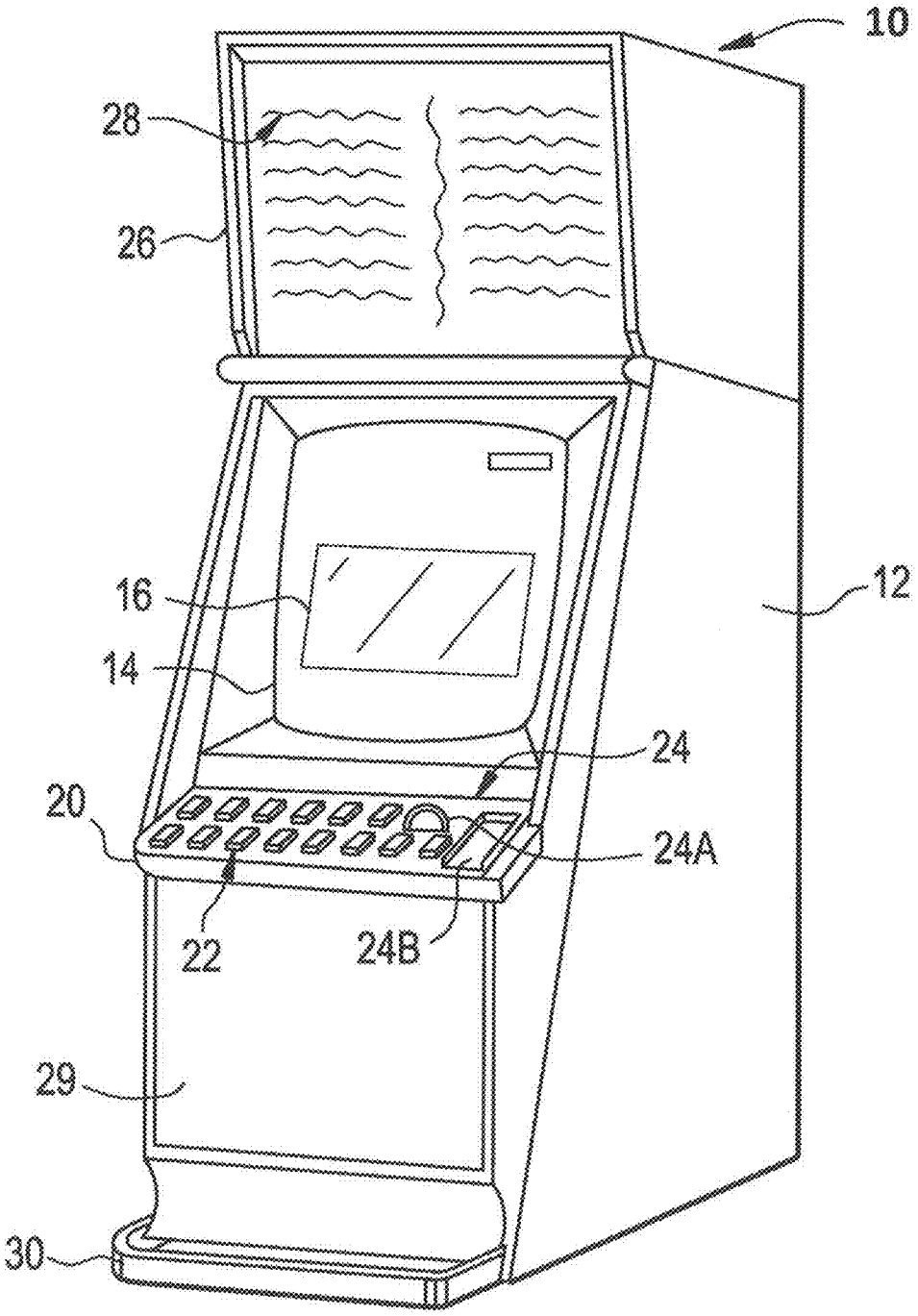
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
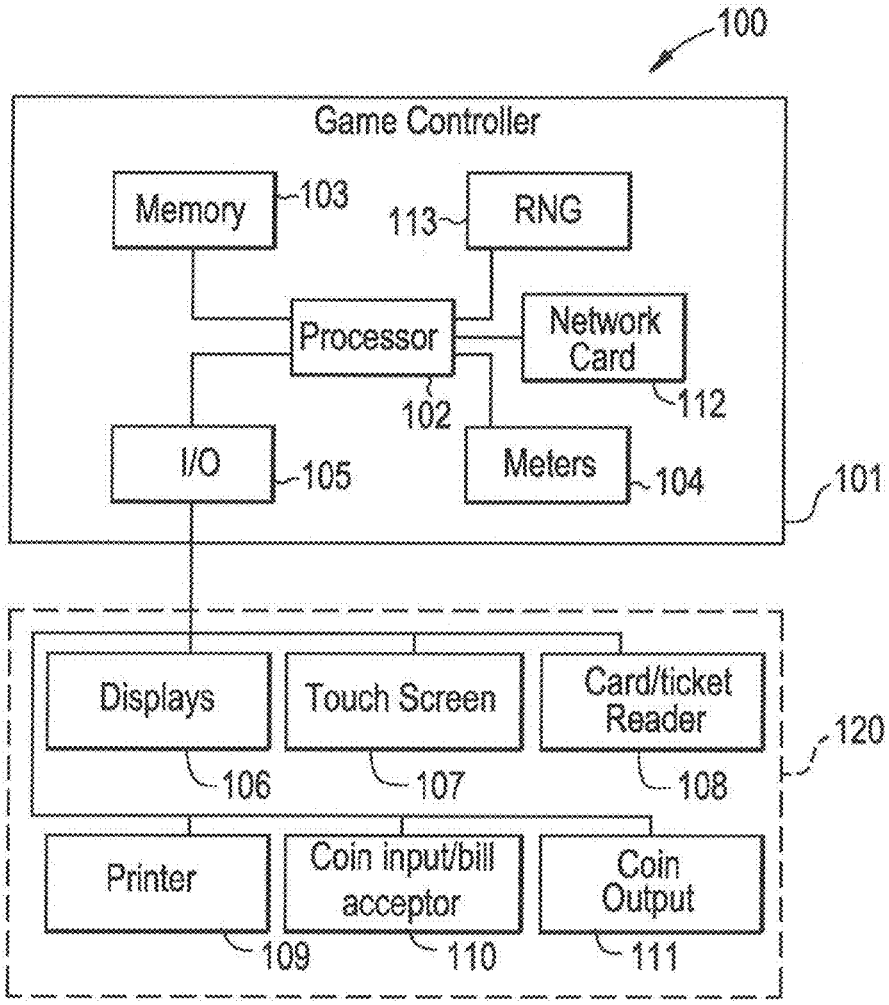
FIG. 3 is a block diagram of the functional components of a gaming machine.

FIG. 3 shows a block diagram of operative components of a typical gaming machine which may be the same as or different to the gaming machine of FIG. 2.

The gaming machine 10 includes a game controller 101 having a processor 102 mounted on a circuit board. Instructions and data to control operation of the processor 102 are stored in a memory 103, which is in data communication with the processor 102. Typically, the gaming machine 10 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
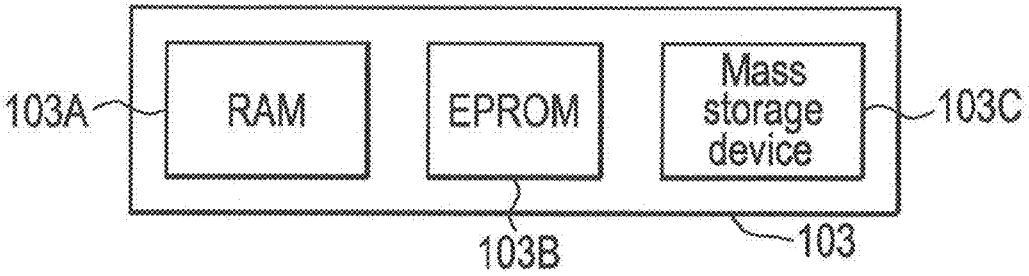
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
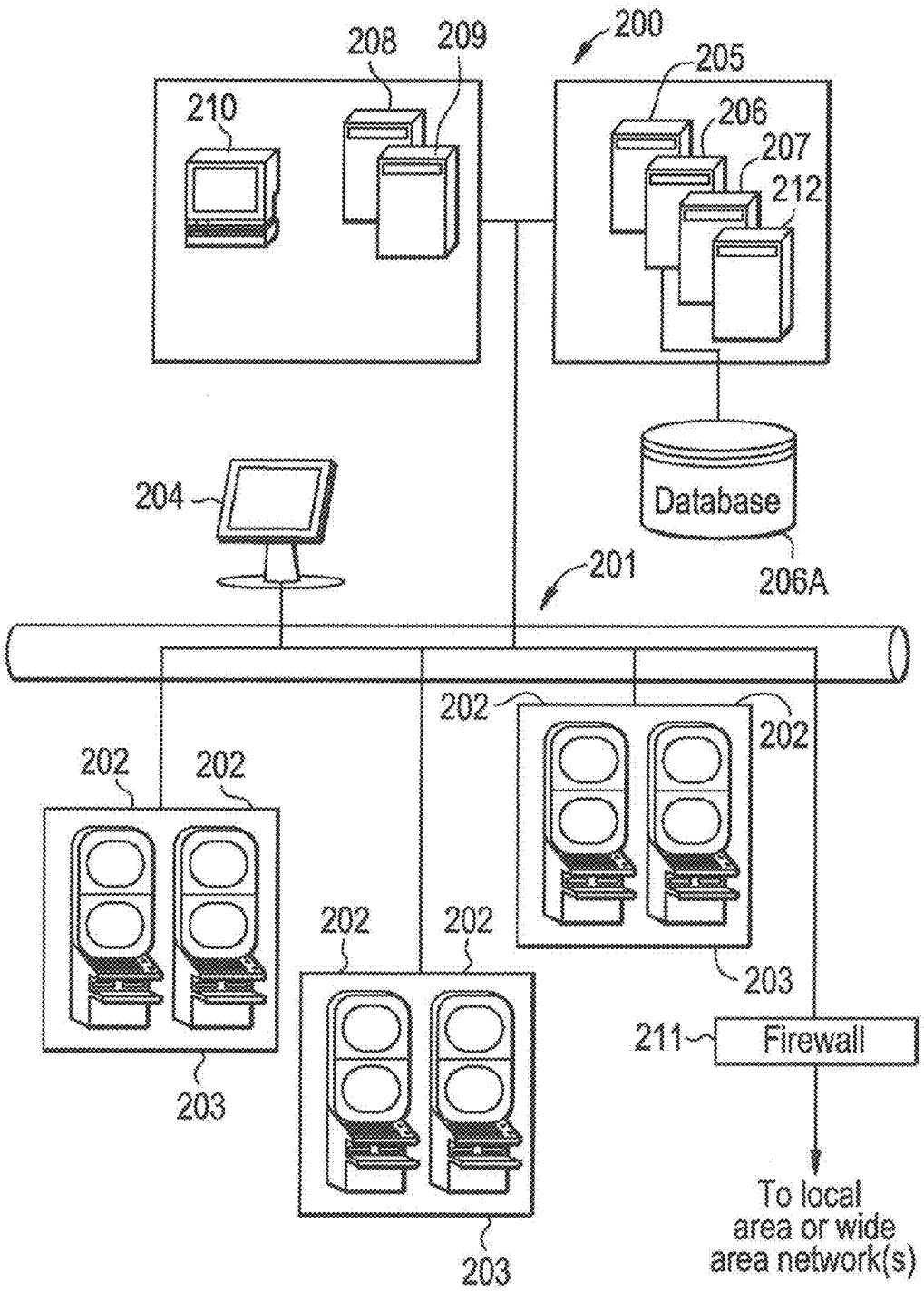
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

Figure 6:
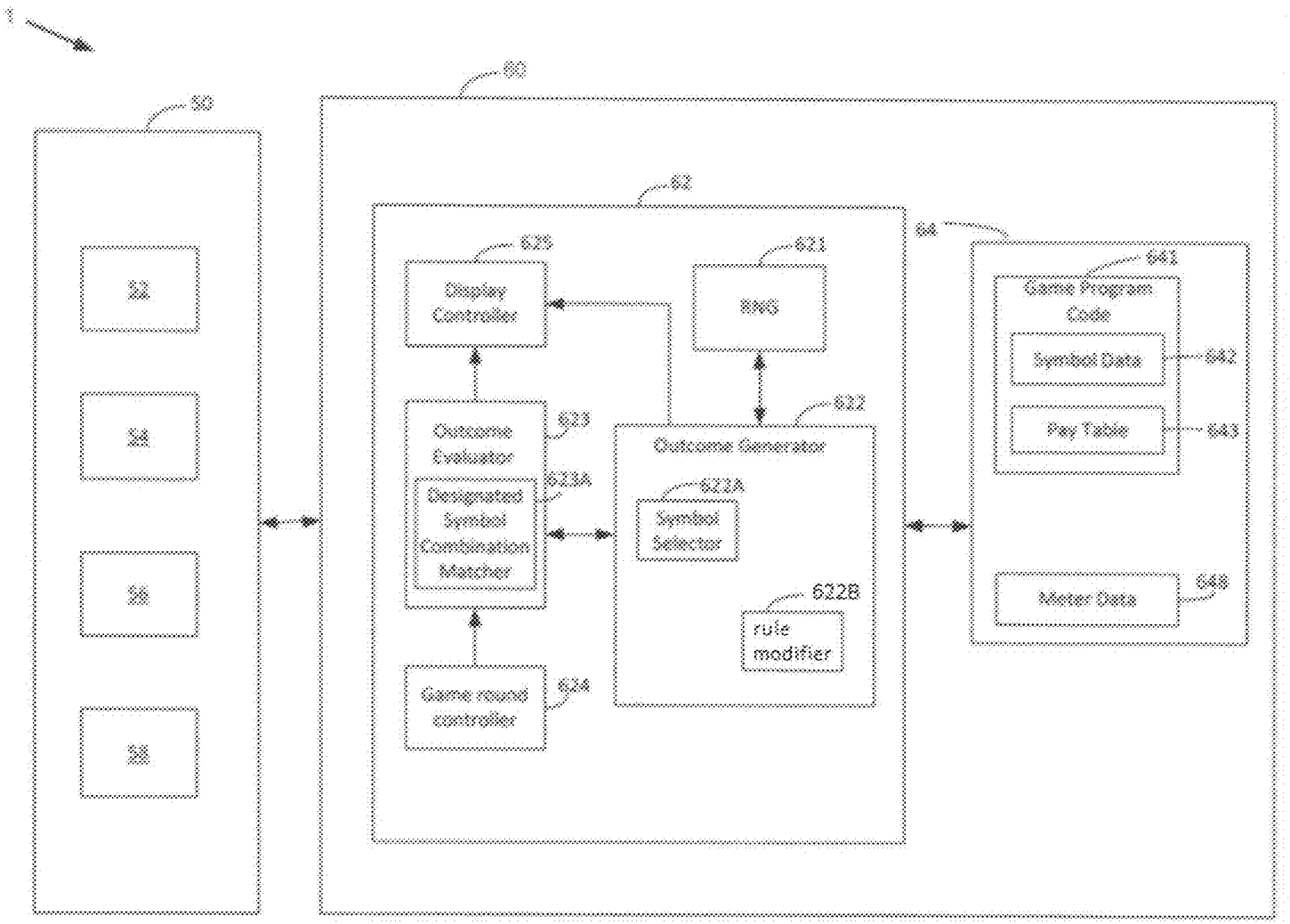
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by outcome evaluator 623. The first part of forming the game outcome is for a symbol selector 622A to select symbols from a set of symbols specified by symbol data 642 using random number generator 621. The selected symbols are advised to the display controller 625 which causes them to be displayed as a symbol display on display 54 at a set of display positions.

In the embodiment described below, the display positions of the symbol display are arranged in a rectangular matrix comprising a plurality of columns and a plurality of rows. However, in other arrangements as known in the gaming industry could be employed in embodiments of the invention. For example, in some arrangements there are more symbols in some columns than other, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighbouring reel.

Figure 7:
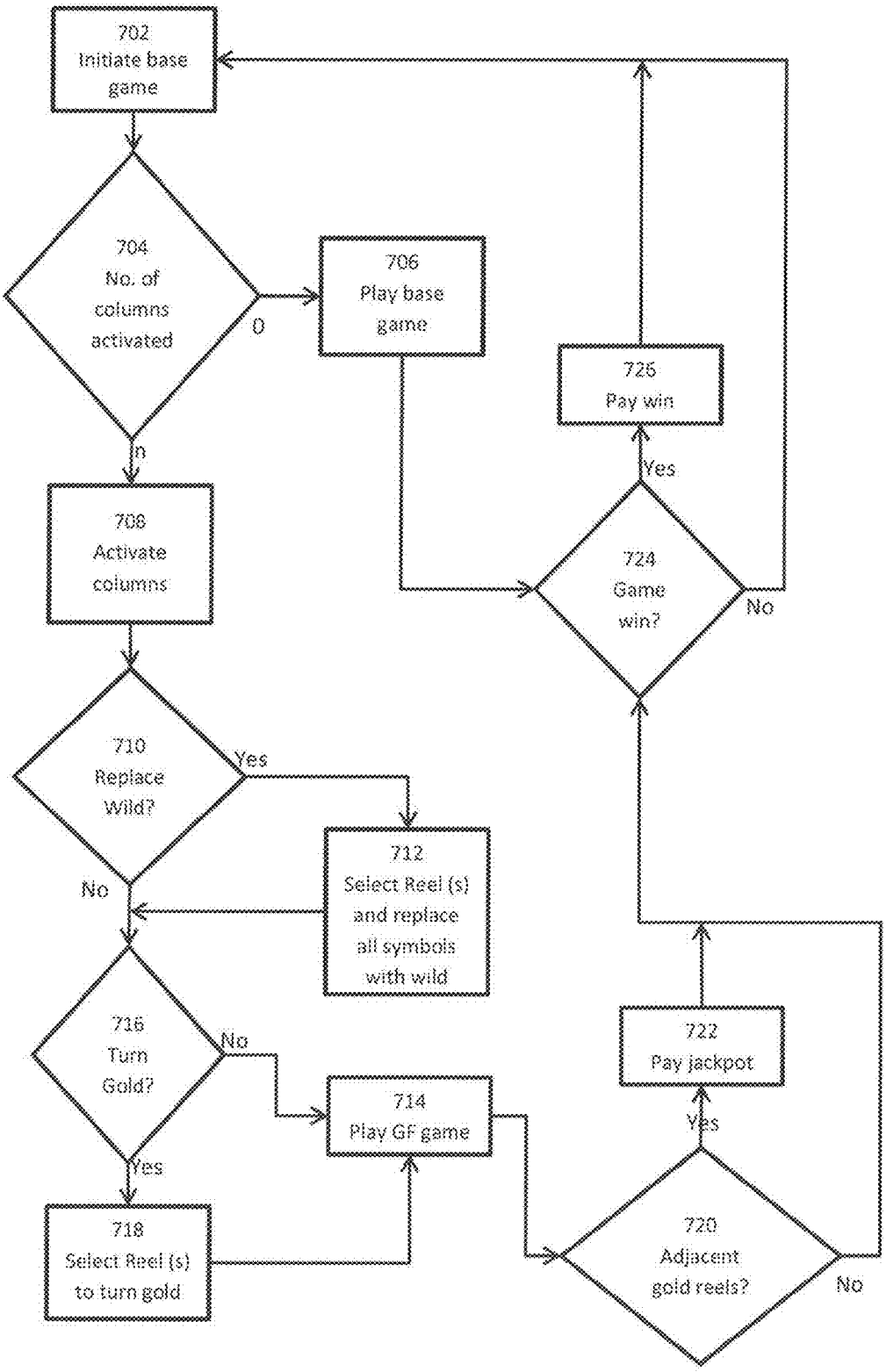
FIG. 7 is a flow diagram of a feature game of the gaming machine of FIG. 2.

Referring to FIG. 7, a base game is initiated at step 702. At step 704, controller 60 determines whether any of the columns have been activated. In this embodiment, columns are activated through payment of an additional wager when the game is initiated, for example an ante bet. In one embodiment, the columns are activated in reverse sequential order. For example, reel 5 must be activated before reel 4 may be activated, and both reels 5 and 4 must be activated before reel 3 may be activated. In other embodiments, reels may be activated selectively by a player, or randomly by controller 60, etc.

If no columns are activated, a standard base game is played at step 706, in which symbol selector 622A selects symbols for display at respective ones of the plurality of display positions. Any game wins, as determined at step 724, are paid at step 726 and control reverts back to step 702.

On the other hand, controller 60 determines that one or more columns are activated at step 704, the columns are activated at step 708. As noted above, one embodiment requires the columns to be activated sequentially, and thus the controller at step 704 determines the number of columns that are to be activated and activates that number of columns in reverse sequential order from column 5.

In one embodiment, activation of at least one column gives the player an opportunity to win a jackpot prize, which would not otherwise be available to players of the standard base game. When a column is activated at step 708, in addition to selecting symbols for display at the respective display positions, symbol selector 622A is also configured to independently select whether a background will be displayed at display positions that are associated with the selected symbol that results in a trigger event. In one embodiment, the background is gold. In other embodiments, the background may be any colour and may in fact be a plurality of different colours. For example, a first jackpot prize may be awarded when a predefined number of gold backgrounds appear in an activated column, and a second jackpot prize may be awarded when a predefined number of silver backgrounds appear in the activated column. In some embodiments, some backgrounds are winning backgrounds that result in a trigger event and other backgrounds are non-winning backgrounds. In embodiments of the invention, the backgrounds are selected from a set of backgrounds configured such that at least one outcome of the of the game includes a display position at which a symbol is overlaid upon a non-winning background.

In an embodiment, another benefit of activating a column is that activated columns may be selected for modification. As shown in step 710, one modification comprises modifying each symbol to be displayed in an activated column into function symbols, such as substitution symbol, also known as a WILD symbol. Additionally or alternatively, another modification is for a background to appear in all display positions of an activated column, which is determined at step 714. In the above embodiments, a jackpot is triggered when a background appears in all the associated display positions of a predefined number of activated columns. Thus having a column selected for modification in this manner increases the chances of a jackpot being triggered. The backgrounds are then displayed in the selected activated columns at step 718.

Once any modifications have been made at steps 712 and 718, the modified game is played at step 716. Outcome evaluator 623 monitors play of the modified game, which includes using symbol selector 622A to select symbols from symbol data 642 for all display positions on the display 54, and backgrounds from background data 644 for display positions associated with activated columns.

At step 720, outcome evaluator 623 determines whether the number of display positions in which the background is selected to appear reaches a predefined threshold. In an embodiment, at least two backgrounds must appear next to one another. In another embodiment, backgrounds must appear in all display positions of an associated column before an event is triggered. Thus if the background in an embodiment is gold shading, a "gold reel"—where gold shading in the whole column—must appear before the event is triggered. In some embodiments, a predefined number of gold reels must appear before the triggered event is a jackpot event—that is, an event in which a jackpot is triggered. In some embodiments, as discussed with reference to the examples below, the predefined minimum number of gold reels required to trigger a jackpot event is three, and progressively larger jackpots are triggered with each additional gold reel that appears. For example, in embodiments where three levels of jackpots are offered, minor, major and grand, a minor jackpot is triggered when three gold reels appear, major when 4 gold reels appear and grand when all five gold reels appear. In these embodiments, it may also be a requirement that the gold reels appear adjacent each other. For example, if reels 3, 4 and 5 turn into gold reels, the minor jackpot is triggered but if reels 2, 3 and 5 turn into gold reels, the jackpot is not triggered.

In this or other embodiments, no prizes are triggered when only one or two gold reels appear. In other embodiments, the appearance of one or two gold reels may trigger a second chance event. In such embodiments, controller 60 may randomly select one or more of columns to turn into a golden reel. If the result of the second chance event is that three or more adjacent columns turn into gold reels, as discussed in the above embodiments, then the minor jackpot is triggered.

In some jurisdictions, jackpot or progressive prizes must be accounted for separately to other in game winnings. The embodiment of FIG. 7 accommodates such jurisdictions, because if it is determined in step 720 that a jackpot has been triggered, it is first accounted for and paid at step 722, before control is passed to step 724 to determine the in game wins. If no jackpot has been triggered, step 720 bypasses step 722 and proceeds directly to step 724 to determine an in game wins. If there are any in game wins, these are paid at step 726 before the game ends and control reverts back to step 702.

Examples

More specific examples of embodiments of the invention are now described with reference to FIGS. 8A-8C. In general, as shown in these Figures, the game has a traditional 3×5 grid layout, and is referred to in the examples below as the "Good Fortune" feature.

Figure 8A:
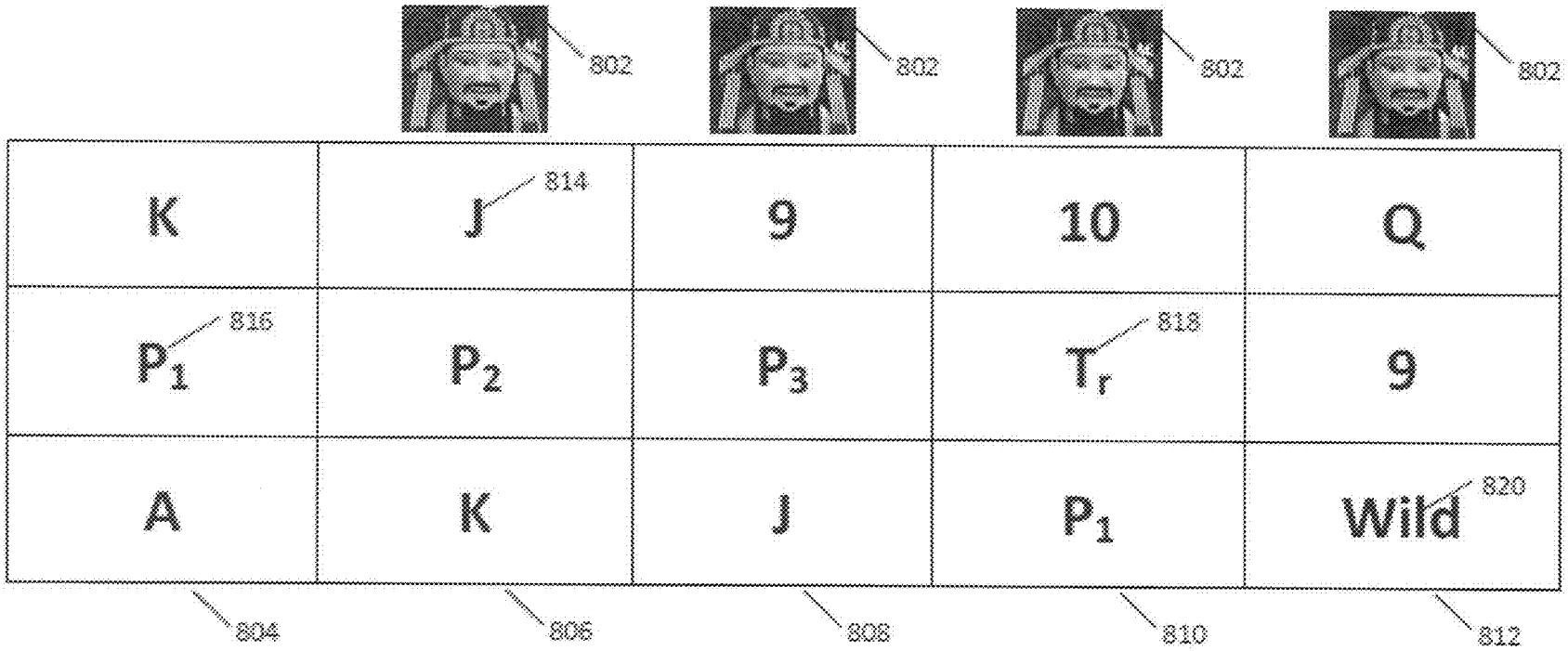
FIGS. 8A to 8C are representations of a screen of the feature game of FIG. 7.

FIG. 8A shows a sample screen shot of the Good Fortune feature. In this embodiment, Choy Sun indicators 802 indicate that reels 806-812 have been activated. As noted above reels are activated in a predefined sequence and in the preferred embodiment, this sequence is from right to left. That is, a first ante bet would activate reel 812, a second ante bet would activate reel 810 and so on to reel 806. In some embodiments, the first reel 804 is automatically activated when the maximum bet is placed on the base game. Thus for Reel Power™ games developed by the applicant, reel 804 is automatically activated when all reels are in play in the base game. For more traditional base games, reel 804 is automatically activated when max lines are in play.

The FIG. 8A screen shot captures a moment in between games. That is, the previous game has completed and controller 60 is waiting at step 702 for player input to initiate the next game. In the previous game, symbol selector 623 has selected for display a plurality of royal symbols 814, a plurality of picture symbols 816, a trigger symbol 818 and a WILD symbol 820. The previous game did not result in any wining outcomes.

Figure 8B:
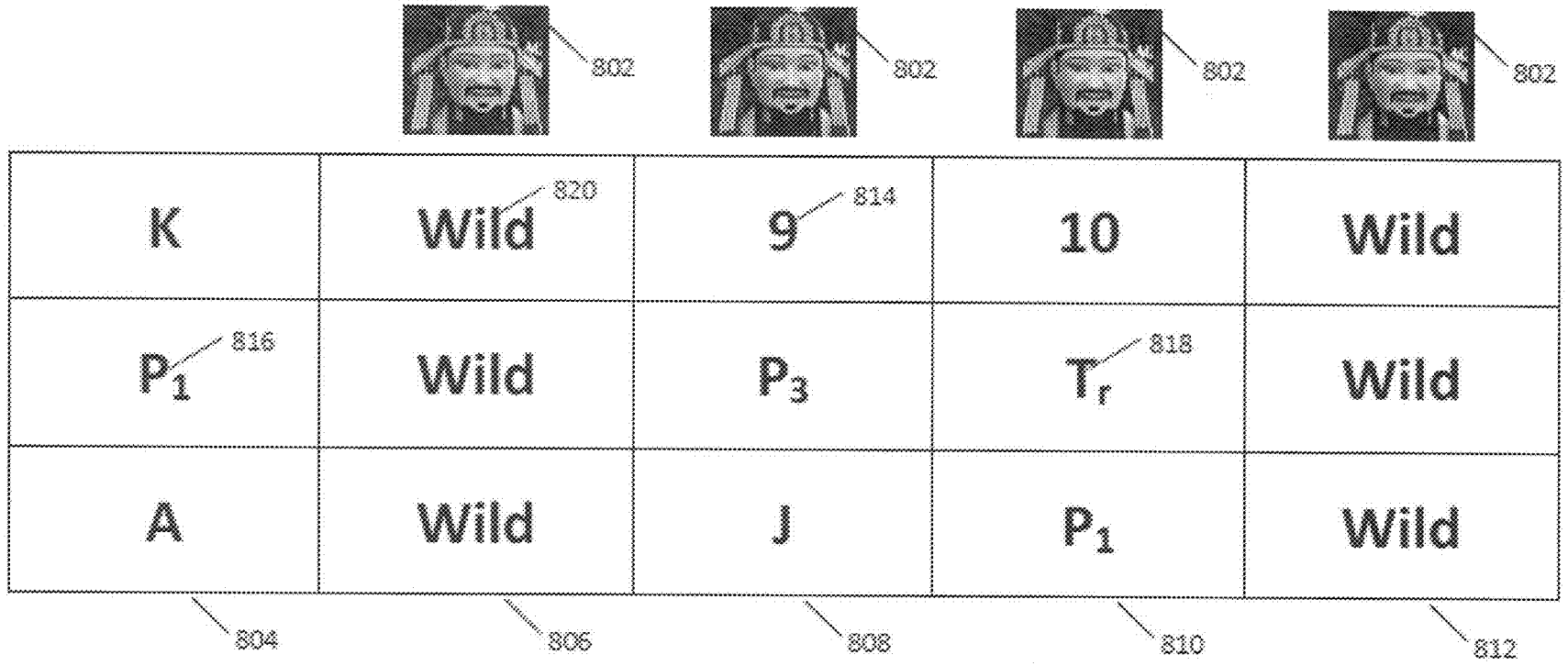

In the example of FIG. 8B, controller 60 at step 710 has determined that reels 806 and 812 should be modified by transforming all the existing symbols on those reels to WILD symbols 820 before any symbols are selected for the next came. Once the symbols on reels 806 and 816 have been transformed, all reels 804 to 812 are spun to select the symbols for display in the subsequent game. Note that in this embodiment, all the symbols on reels 806 and 812 are transformed to WILD symbols 820. Therefore, any symbol selected for display at any of the display positions on reels 806 and 812 will automatically be transformed into WILD symbols 820. Also, in this embodiment, WILD symbols 820 substitute for any royal and picture symbol 814 and 816, but not trigger symbol 818 or any gold background. In other embodiments, WILD symbols may substitute for any symbol, including triggers. In yet other embodiments, WILD symbols may also substitute for a background. Such additional functionality may be implemented by default, or may be acquired through an additional wager, or through an achievement in the game.

Figure 8C:
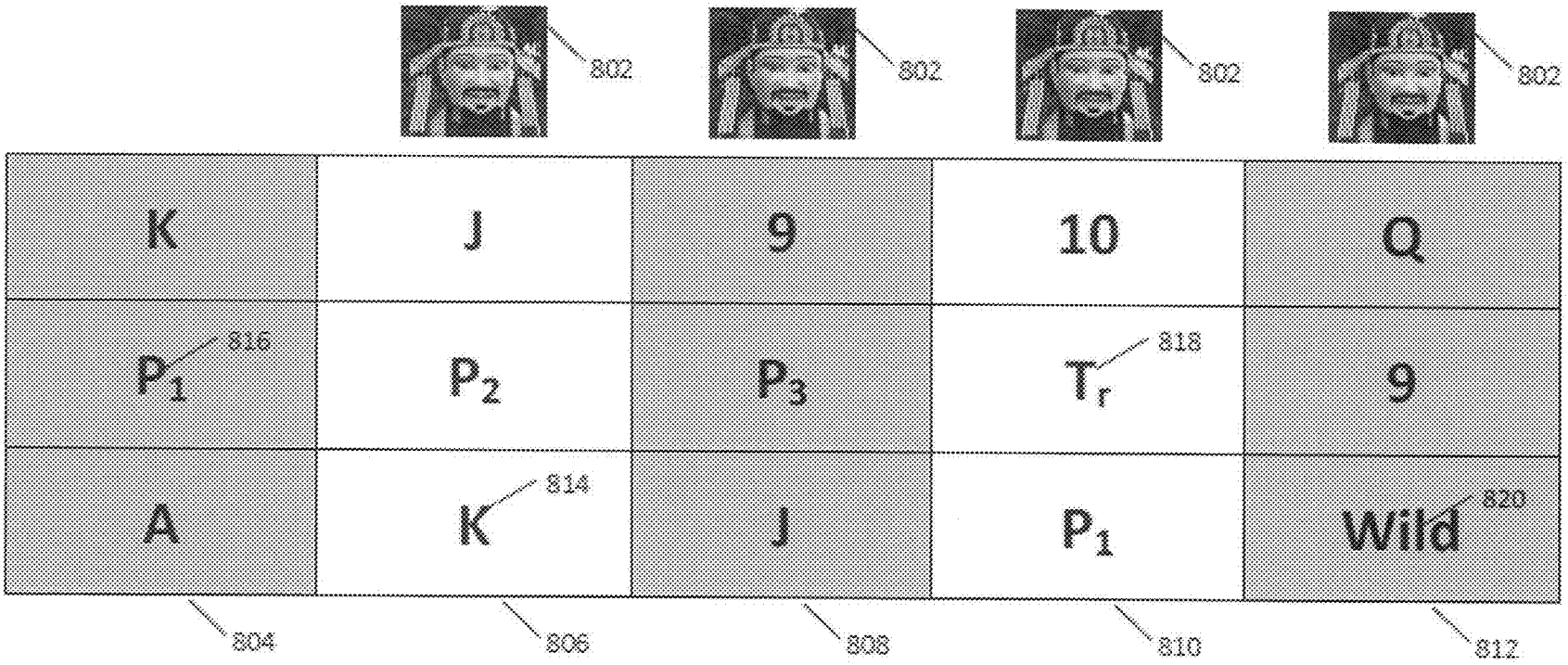

In the example of FIG. 8C, controller 60 has determined at step 714 that reels 804, 808 and 812 are to become gold reels, as indicated by the shaded reels in FIG. 8C. As noted above, in some embodiments the first reel 804 is automatically activated without the requirement of an additional wager. In embodiments where a jackpot is only triggered when adjacent reels are turned gold, the example of FIG. 8C does not result in the jackpot being triggered. However, a second chance event is triggered because at least one reel has turned gold. The second chance event selects at least one of the reels to turn into a gold reel. In some embodiments, that reel is selected only from reels that are not already gold, or in this case from reels 806 or 810. In that case, the second chance event guarantees that a jackpot will be triggered. In other embodiments, the reel selected to be turned gold may be selected from any of the reels. In that case, if reel 804, 808 or 812 is selected, the second chance event will not result in a jackpot being triggered.

Furthermore, in the embodiments discussed above, modifications to transform symbols into WILD symbols or to display a gold background are performed symbol selector 623 selects the plurality of symbols and the plurality of backgrounds. However, it will be appreciated that such modifications may be performed after symbols and backgrounds are selected. In some embodiments, such modifications may occur when the modification results in a more optimal outcome for the player.

In an embodiment, the above is implemented using a first reel comprising plurality of symbols overlying a second reel comprising a plurality of gold backgrounds (which can be considered as winning backgrounds) and a plurality of blank positions (which can be considered as non-winning backgrounds). The reels are spun independently so that a symbol will not necessary stop on a gold background in a given display position. On the second reel, the gold backgrounds are preferably organized into a plurality of stacks of at least three positions tall, so that at certain stopping positions, the gold background appears in all viewable display positions of that reel, turning it into a "gold reel".

In embodiments of the invention, as mentioned, a minimum of three adjacent gold reels triggers a prize of a jackpot, with each additional adjacent gold reel triggering progressively larger prizes or jackpots. For example, in one embodiment, three adjacent gold reels awards a predefined a credit prize; four adjacent gold reels awards a jackpot feature and five adjacent gold reels awards the jackpot feature and a progressive jackpot prize.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further, different parts of the program code can be executed by different devices, for example in a client server relationship. Persons skilled in the art, will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A method, comprising:

displaying a wager outcome as a column of symbols on each of a plurality of reels on a display device of an electronic gaming machine;

awarding a first prize in response to the wager outcome comprising a first predetermined quantity of reels that present their column of symbols with a first background color; and prior to awarding the first prize:

selecting a reel of the plurality of reels in response to determining that the wager outcome does not include the first predetermined quantity of reels that present their column of symbols with the first background color; and modifying the selected reel to present its column of symbols with the first background color.

2. The method of claim 1, further comprising awarding a second prize in response to the wager outcome comprising a winning combination of symbols.

3. The method of claim 1, further comprising awarding a second prize in response to the wager outcome comprising a second predetermined quantity of reels that present their column of symbols with a second background color.

4. The method of claim 1, wherein awarding the first prize comprises awarding the first prize after determining that the first predetermined quantity of reels are adjacent reels.

5. The method of claim 1, wherein selecting the reel comprises selecting the reel from one or more of the plurality of reels which do not present their column of symbols with the first background color.

6. The method of claim 1, further comprising replacing one or more symbols of the selected reel with a function symbol.

7. The method of claim 1, further comprising replacing one or more symbols of the selected reel with a WILD symbol.

8. A gaming machine, comprising:

a credit input device;

a display device;

a player interface; and a processor that executes instructions stored in a memory, wherein execution of the instructions causes the processor to at least:

establish a credit balance based on a physical item received by the credit input device;

initiate play of a game based on input received via the player interface;

present, via the display device, an outcome of the game that includes columns of symbols;

award a first prize to the credit balance in response to the outcome comprising a first predetermined quantity of columns that present their symbols with a first background color;

select a column from one or more of the columns of symbols that do not present their symbols with the first background color; and modify the selected column to present its symbols with the first background color.

9. The gaming machine of claim 8, wherein execution of the instructions further causes the processor to award a second prize to the credit balance in response to the outcome comprising a winning combination of symbols.

10. The gaming machine of claim 8, wherein execution of the instructions further causes the processor to award a second prize to the credit balance in response to the outcome comprising a second predetermined quantity of columns that present their symbols with a second background color.

11. The gaming machine of claim 8, wherein execution of the instructions further causes the processor to award the first prize after determining that the first predetermined quantity of columns are adjacent.

12. The gaming machine of claim 8, wherein execution of the instructions further causes the processor to select the column from the columns of symbols in response to determining that the outcome does not include the first predetermined quantity of columns that present their symbols with the first background color.

13. The gaming machine of claim 8, wherein execution of the instructions further causes the processor to replace one or more symbols of the selected column with a function symbol.

14. The gaming machine of claim 8, wherein execution of the instructions further causes the processor to replace one or more symbols of the selected column with a WILD symbol.

15. A non-transitory computer readable storage medium comprising instructions, that in response to being executed, cause a gaming machine to:

initiate play of a game based on input received via a player interface of the gaming machine;

present, via a display device of the gaming machine, an outcome of the game that includes columns of symbols;

award a first prize in response to the outcome comprising a first predetermined quantity of columns that present their symbols with a first background color;

award a second prize in response to the outcome comprising a winning combination of symbols;

select a column from one or more of the columns of symbols that do not present their symbols with the first background color; and modify the selected column to present its symbols with the first background color.

16. The non-transitory computer readable storage medium of claim 15, wherein the instructions further cause the gaming machine to award a third prize in response to the outcome comprising a second predetermined quantity of columns that present their symbols with a second background color.

17. The non-transitory computer readable storage medium of claim 15, wherein the instructions further cause the gaming machine to award the first prize after determining that the first predetermined quantity of columns are adjacent.

18. The non-transitory computer readable storage medium of claim 15, wherein the instructions further cause the gaming machine to select the column of the columns of symbols in response to determining that the outcome does not include the first predetermined quantity of columns that present their symbols with the first background color.

19. The non-transitory computer readable storage medium of claim 15, wherein the instructions further cause the gaming machine to replace one or more symbols of the selected column with a function symbol.

20. The non-transitory computer readable storage medium of claim 15, wherein the instructions further cause the gaming machine to replace one or more symbols of the selected column with a WILD symbol.

* * * * *